US008893858B2

(12) United States Patent
Shi et al.

(10) Patent No.: US 8,893,858 B2
(45) Date of Patent: Nov. 25, 2014

(54) METHOD AND SYSTEM FOR DETERMINING SAFETY OF ELEVATOR

(75) Inventors: Juan Shi, Heilongjiang (CN); Pei Qing, Heilongjiang (CN); Yixuan Zou, Heilongjiang (CN)

(73) Assignee: Empire Technology Development LLC, Wilmington, DE (US)

( * ) Notice: Subject to any disclaimer, the term of this patent is extended or adjusted under 35 U.S.C. 154(b) by 662 days.

(21) Appl. No.: 13/141,327

(22) PCT Filed: Jun. 29, 2010

(86) PCT No.: PCT/CN2010/074675

§ 371 (c)(1), (2), (4) Date: Jun. 22, 2011

(87) PCT Pub. No.: WO2012/000170

PCT Pub. Date: Jan. 5, 2012

(65) Prior Publication Data

US 2011/0315490 A1 Dec. 29, 2011

(51) Int. Cl.
*B66B 1/34* (2006.01)
*B66B 5/00* (2006.01)

(52) U.S. Cl.
CPC ..... *B66B 5/0025* (2013.01)
USPC ..... 187/391; 187/247

(58) Field of Classification Search
USPC ..... 187/247, 391–393
See application file for complete search history.

(56) References Cited

U.S. PATENT DOCUMENTS

| | | | | |
|---|---|---|---|---|
| 4,512,442 | A * | 4/1985 | Moore et al. | 187/393 |
| 5,064,026 | A * | 11/1991 | Nagata et al. | 187/391 |
| 5,522,480 | A * | 6/1996 | Hofmann | 187/391 |
| 5,869,794 | A | 2/1999 | Spiess | |
| 7,143,001 | B2 | 11/2006 | Karasek | |
| 7,823,706 | B2 * | 11/2010 | Tyni et al. | 187/393 |
| 8,418,815 | B2 * | 4/2013 | Encinas Carreno et al. | 187/390 |
| 8,540,057 | B2 * | 9/2013 | Schuster et al. | 187/391 |

FOREIGN PATENT DOCUMENTS

| | | |
|---|---|---|
| CN | 1673062 | 9/2005 |
| CN | 101172550 | 5/2008 |
| CN | 101500924 | 8/2009 |
| JP | 9-2752 | 1/1997 |
| JP | 11217163 | 8/1999 |
| JP | 2006-8381 | 1/2006 |
| JP | 200784243 | 4/2007 |

OTHER PUBLICATIONS

Notification of Transmittal of the International Search Report and the Written Opinion of the International Searching Authority, Apr. 7, 2011.

* cited by examiner

*Primary Examiner* — Anthony Salata
(74) *Attorney, Agent, or Firm* — Ren-Sheng International

(57) ABSTRACT

In accordance with at least some embodiments, a process for determining the safety of an elevator may be implemented to collect, by an acceleration sensor, an operational measurement of the elevator in operation, wherein the operational measurement includes a velocity measurement of the elevator. The process may be implemented to determine, by a processor, an operational status of the elevator by evaluating the operational measurement. The process may further be implemented to generate, by the processor, a warning signal when the operational status indicates that the elevator is operating abnormally.

20 Claims, 4 Drawing Sheets

METHOD AND SYSTEM FOR DETERMINING SAFETY OF ELEVATOR

CROSS REFERENCE TO RELATED APPLICATION

The present application is a 371 application of the International Application PCT/CN2010/074675, filed on Jun. 29, 2010 and entitled "Intelligent Elevator Safety Monitor." The disclosure of the forgoing application is hereby incorporated by reference in its entirety, including any appendices or attachments thereof, for all purposes.

BACKGROUND

Unless otherwise indicated herein, the approaches described in this section are not prior art to the claims in this application and are not admitted to be prior art by inclusion in this section.

Electric and hydraulic elevators have been used extensively for many years to transfer people and/or goods from one building floor to another. A traditional approach in maintaining elevator safety is to conduct routine maintenance and perform periodical examinations, which rely heavily on operator-controlled alarming systems during elevator troubleshooting. Since different elevators may be operating under different loading conditions, resulting in different degrees of wear and tear, these routine examinations may fail to detect hidden faults caused by long term usage. Further, many of the periodical examinations lack specific objectives, and a thorough examination of an elevator can be costly in terms of time and labor.

Moreover, many elevator safety systems focus on damage reduction rather than accident prevention. Thus, when an elevator malfunctions, the passengers of the elevator can only rely on the emergency braking system of the elevator to reduce potential injuries or property damage. The passengers are not warned in advance.

SUMMARY

In accordance with some embodiments of the present disclosure, a method for determining the safety of an elevator is generally described. The method includes collecting, by an acceleration sensor, an operational measurement of the elevator, wherein the operational measurement comprises a velocity measurement of the elevator. The method also includes determining, by a processor, an operational status of the elevator by evaluating the operational measurement, and generating, by the processor, a warning signal when the operational status indicates that the elevator is operating abnormally.

In accordance with other embodiments of the present disclosure, a method for determining the safety of an elevator is generally described. The method includes collecting, by an acceleration sensor, a velocity measurement of the elevator as the elevator is in operation, collecting, by a noise sensor, a noise measurement of the elevator as the elevator is in operation, and determining, by a processor, an operational status of the elevator by comparing the velocity measurement with a baseline velocity measurement and comparing the noise measurement with a baseline noise measurement.

In accordance with further embodiments of the present disclosure, a system configured to determine the safety of an elevator is generally described. The system includes an acceleration sensor to collect a velocity measurement of the elevator, a microphone to collect a noise measurement of the elevator, and a processor coupled with the acceleration sensor and the microphone. The processor is configured to determine an operational status of the elevator by evaluating the velocity measurement and the noise measurement and to generate a warning signal upon a determination that the operational status indicates that the elevator is operating abnormally.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
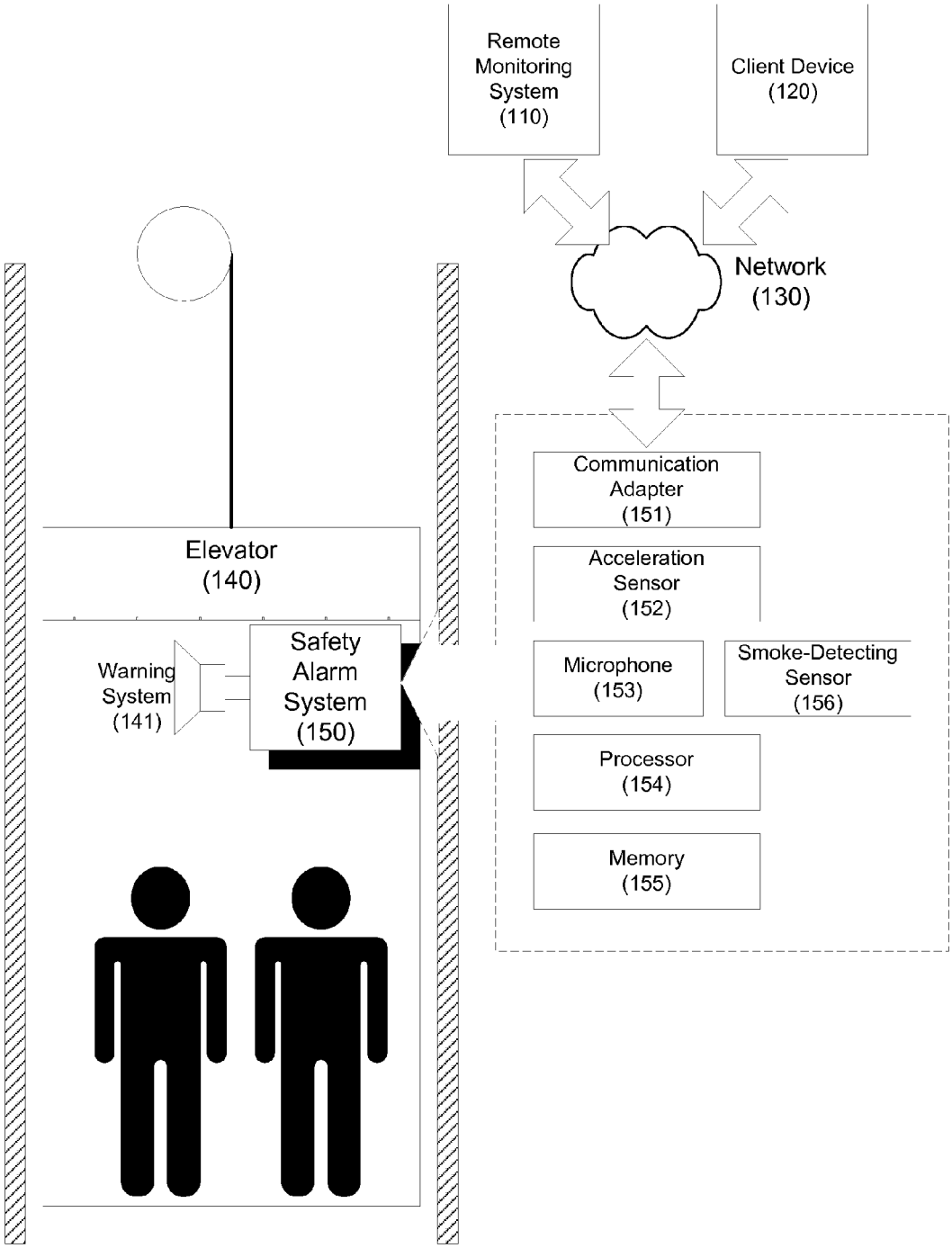
FIG. 1 shows a block diagram of an illustrative embodiment of an operational environment in which a safety alarm system is configured to detect an elevator operating abnormally.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

This disclosure is drawn, inter alia, to methods, apparatus, computer programs, and systems related to an intelligent safety alarm system for elevators. Throughout the disclosure, the term "operational mode" may broadly refer to the state of an elevator is in during operation. At any time, the elevator may be in a specific operational mode having one or more of the following non-limiting values: idle, moving up, moving down, loaded, unloaded, acceleration, and/or deceleration. For example, an operational mode of "loaded, acceleration, moving up" may indicate that the elevator is loaded with passengers and is travelling up a building in an accelerating speed. An "unloaded idle" operational mode may indicate the elevator is empty and idle, awaiting further instruction. The term "operational status" may broadly refer to the condition of an elevator during operation. For example, an elevator may have an operational status such as, without limitation, "normal," "under-stress," "abnormal," or "broken". Thus, the operational status may indicate whether the elevator is functioning normally or abnormally.

The term "operational measurement" may broadly refer to a collected real-time value or values related to the operation of an elevator. For example, the operational measurements may be used to describe the characteristics of a moving elevator, such as its velocity, inside temperature, existence of smoke, light intensity, or loading weight. Each of the above operational measurements may be represented by a value in a specific unit of measurement (e.g., meter/second, pound, or others). Further, the operational measurements may be collected and/or detected by various electrical or mechanical sensors. In some embodiments, an intelligent safety alarm system for elevators may utilize Micro-Electro-Mechanical-Systems (MEMS) sensors to collect operational measurements such as the acceleration and noise of an operating elevator. In certain instances, the operational mode, operational status, and operational measurements may be collectively referred to as "operational data."

The term "abnormal condition" or "operating abnormally" may broadly refer to an elevator not operating in an ideal or normal condition. For example, the elevator may be operating in an overloaded condition, or the elevator may not be functioning as designed. Further, the abnormal condition may include situations in which the elevator is operational, but may have a high probability of malfunctioning. The abnormal condition may also cover the situations in which some components of the elevator are breaking down or are already broken.

In at least some embodiments of the present disclosure, an intelligent safety alarm system may be installed in a new or existing elevator. By using the sensors contained in the safety alarm system to collect real-time operational measurements associated with an operating elevator, the safety alarm system may be configured to determine the operational mode and operational status of the elevator. For example, based on the collected real-time operational measurements such as the real-time acceleration values or operational noise data, a processor of the safety alarm system may determine the current operational mode of the elevator. Further, based on the elevator's current operational mode, the processor may retrieve a set of baseline operational measurements and compare the baseline operational measurements with the real-time operational measurements previously collected by the sensors. If the processor determines that the elevator is functioning abnormally or is prone to causing an accident, the processor may generate a warning signal and transmit the warning signal to a remote monitoring system or a client device. Upon receiving the warning signal, a warning system in the elevator may generate audible and/or visual alarms to warn the passengers inside the elevator. The safety alarm system may be a portable device that is installable into existing or legacy elevators and used for troubleshooting the elevators. By utilizing the safety alarm system with the elevators, potential failures that could cause serious personal injuries and property damages may become predictable and preventable.

FIG. 1 shows a block diagram of an illustrative embodiment of an operational environment in which a safety alarm system is configured to detect an elevator operating abnormally. In FIG. 1, an elevator 140, which may be used to carry passengers (i.e., a passenger elevator) and/or physical objects (i.e., a freight elevator), may be a moving compartment of an elevator system. The elevator 140 may contain, among other things, a safety alarm system 150, which may be integrated as a component of the elevator 140 or be later attached or coupled to the elevator 140. As depicted in FIG. 1, the safety alarm system 150 may include, among other things, at least one acceleration sensor 152, at least one microphone 153, a processor 154, a memory 155, and a communication adapter 151. The safety alarm system 150 may be coupled with a warning system 141, and may include additional components (not shown in FIG. 1) such as power adapter, display, control panel, etc. Further, any of the components of the safety alarm system 150 may be implemented internal or external to the safety alarm system 150.

In some embodiments, the acceleration sensor 152 and the microphone 153 may collect multiple operational measurements of the elevator 140, and transmit the collected operational measurements to the processor 154. The processor 154 may then use the received operational measurements to determine an operational mode and/or an operational status of the elevator 140. Upon a determination that the elevator 140 is operating abnormally, the safety alarm system 150 may cause the warning system 141 to generate and broadcast audible and/or visual alarms. The processor 154 may store the collected operational measurements and/or baseline measurements in the memory 132, for example, during data analysis. The communication adapter 151 may transmit the operational measurements, the operational mode, the operational status or warning signals to a remote monitoring system 110 or a client device 120 via a network 130.

In some embodiments, the elevator 140 may be a vertical or horizontal lifting or transporting vehicle. The elevator 140 may be powered by electric motors that either drive traction cables and counterweights, or pump hydraulic fluid to raise or lower a cylindrical piston. Alternatively, the elevator 140 may also be a crane, a tram, or any type of lift or conveyance belt that may transport people and/or physical objects. The elevator 140 may usually be maintained by scheduled examinations and tunings. However, scheduled maintenance tests may be expensive in labor and time, and may not be sufficient in preventing sudden elevator accidents. For example, if a specific maintenance test is not thoroughly performed, or there are potential hidden problems in the elevator that are not timely detected, the elevator may cause serious accidents resulting in great loss to life and property. Furthermore, older models of elevators may lack the means, such as an emergency braking system, to prevent or reduce loss due to accidents. Therefore, regardless of whether the elevator 140 is a modern or legacy one, by utilizing an easy-to-install, stationary or portable elevator safety alarm system, such as the safety alarm system 150, the probability of elevator accidents may be greatly reduced, and the safety of passenger and property may be greatly improved.

In some embodiments, the safety alarm system 150 may utilize multiple types of electronic and/or mechanical sensors to determine the operational status of the elevator 140. When coupled with the elevator 140, the safety alarm system 150 may continuously collect operational measurements in real-time, and determine whether the elevator 140 is functioning normally or abnormally. In FIG. 1, the safety alarm system 150 is depicted as having one acceleration sensor 152 and one microphone 153. Alternatively, the safety alarm system 150 may have additional sensors that are used to collect various other operational measurements. For example, the safety alarm system 150 may include a smoke-detecting sensor 156 to detect the existence of smoke in the elevator, a light sensor to detect the adequacy of the lighting in the elevator, or other sensors to detect the performance of the elevator's mechanic and electronic components.

In some embodiments, the acceleration sensor 152 may measure accelerations, vibrations, shocks, movements, gravity accelerations or other parameters associated with the movement of the elevator 140. The acceleration sensor 152 may integrate movement sensing, analog signal processing, or digital signal processing into a single chip. In some embodiments, the acceleration sensor 152 may be a MEMSIC MEMS accelerometer that utilizes MEMS technology. The MEMS technology integrates mechanical elements with sensors, actuators and electronics components on a common silicon substrate through micro-fabrication process. This MEMS technology allows the acceleration sensor to be smaller, more energy efficient, and more portable. Other suitable acceleration sensors or accelerometers may also be used by the safety alarm system 150 to sense the movement of the elevator 140.

In some embodiments, the acceleration sensor 152 may utilize a heat source to measure the changes in velocity and acceleration. Air may be sealed inside of the acceleration sensor chip with the heat source placed in the middle of the chip. When the physical object monitored by or attached to the acceleration sensor is in motion, the air inside of the chip, attributed to inertia, remains static for a short period of time. However, the movement may cause the heat source to change the temperature, density and/or pressure of the sealed air. The acceleration sensor 152 may detect these changes through calculations performed on the thermodynamic parameters of the sealed air, and the acceleration sensor 152 may derive the object's velocity and acceleration based on these calculations. Further, an acceleration sensor may be capable of measuring acceleration changes in multiple dimensions. For example, a MEMS accelerometer may be able to measure velocity changes both in the up-down axle and the left-right axle.

In some embodiments, the microphone 153 may be a noise sensor to detect noise levels. The microphone 153 may be a silicon micro-microphone with sufficient sensitivity and frequency response range to measure the inside and outside noise levels of the operating elevator 140. An abnormal noise level in the elevator often indicates defects in the mechanical and electrical components. For example, an unusually loud motor may be a sign of the motor being in the verge of breakdown. Likewise, a quiet motor may alert the maintenance crew that the motor either lost its power or is totally broken. The microphone 153 may collect the sound waves inside of or near the elevator 140, and convert the sound waves into noise operational measurements, which may be further evaluated and analyzed.

In some embodiments, the processor 154 may determine the operational mode and the operational status of the elevator 140 based on the operational measurements collected by various sensors. The processor 154 may analyze these measurements and generate a warning signal accordingly. Further, the processor 154 may retrieve/store data from/to the memory 155, and communicate with external systems such as the remote monitoring system 110 or the client device 120 via the communication adapter 151. In some embodiments, the processor 154 may be a single-chip microprocessor such as, by way of example and not limitation, an AVR RISC architecture based low-power CMOS 8-bit single chip microprocessor such as ATMEL® 128. Alternatively, the processor 154 may be any general or specific computing device that may execute commands based on programmable instructions.

In some embodiments, the processor 154 may utilize the memory 155 to store the operational measurements collected by various sensors, and to retrieve baseline measurements previously stored in the memory 155 for data analysis. The memory 155 may be in any form of random access memory (RAM), read-only memory (ROM), flash memory, conventional magnetic or optical disks, tape drives, or a combination of such devices. The safety alarm system 150 may also communicate with external systems via the communication adapter 151. The communication adapter 151 may be, for example, an Ethernet adapter, a wireless adapter, a Fibre Channel adapter, or a GSM wireless module, etc.

In some embodiments, the safety alarm system 150 may transmit the collected operational measurements to the network 130 via the communication adapter 151. The network 130 may be a wired network, such as local area network (LAN), wide area network (WAN), metropolitan area network (MAN), global area network such as the Internet, a Fibre Channel fabric, or any combination of such interconnects. The network 130 may also be a wireless network, such as mobile devices network (Global System for Mobile communication (GSM), Code Division Multiple Access (CDMA), Time Division Multiple Access (TDMA), etc), wireless local area network (WLAN), wireless Metropolitan area network (WMAN), etc. The operational measurements as well as operational modes and operational statuses of an elevator 140 may be transmitted to the remote monitoring system 110 or the client device 120 in forms of HTTP requests/responses, Wireless Application Protocol (WAP) messages, Mobile Terminated (MT) Short Message Service (SMS) messages, Mobile Originated (MO) SMS messages, or any type of network messages. Alternatively, the remote monitoring system 110 or the client device 120 may be directly coupled to the safety alarm system 150 via a dedicated physical connection (not shown in FIG. 1)

In some embodiments, the remote monitoring system 110 may refer to a computer system or a program to which operational data from multiple elevators may be uploaded. The operational data may then be further reviewed or analyzed separately or independently from the safety alarm system 150. The remote monitoring system 110 may contain a web server application to process user requests in HTTP. The remote monitoring system 110 may be a mobile phone service provider capable of processing phone messages, text messaging, email, and other network messages that carry the data that are related to elevator operations. Further, some or all of the functions performed by the remote monitoring system 110, the client device 120, and the safety alarm system 150 may be integrated or distributed among these systems and devices.

In some embodiments, the client device 120 may be a mobile, handheld computing/communication device, such as Personal Digital Assistant (PDA), cell phone, smart-phone, etc. The client device 120 may also be a conventional personal computer (PC), laptop computer, server-class computer, workstation, etc. If the elevator 140 is located in an area that does not have network connection, or the wireless communication signals generated by the safety alarm system 150 may not reach the remote monitoring system 110, the client device 120 may be utilized to directly couple to the safety alarm system 150 for downloading and accessing the warning signals generated by the safety alarm system 150. Alternatively, the client device 120 may be positioned within the safety alarm system 150's wireless communication range to receive the warning signals. Therefore, the client device 120 may allow maintenance personals to quickly respond to the potential problems in order to resolve the safety issues as soon as possible.

In some embodiments, the safety alarm system 150, the client device 120, and/or the remote monitoring system 110 adopt LabVIEW® applications to acquire, analyze and process operational data associated with the elevator 140. The LABVIEW programming tools utilize a graphical development software environment for data acquisition and instrument control. Data analysis and instrument control programs created by LABVIEW are modularized, easy to debug, and easy to maintain. Further, the LABVIEW program may also be integrated with bus drivers such as RS232, GPIB, VCI, etc, which greatly simplifies the controlling of data communication and processing of data. For example, the signals collected through communication ports of the elevator control system (not shown in FIG. 1) may be directly accessed by the safety alarm system 150, and be transmitted to the remote monitoring system 110 for processing through the LABVIEW software programs.

Figure 2A:
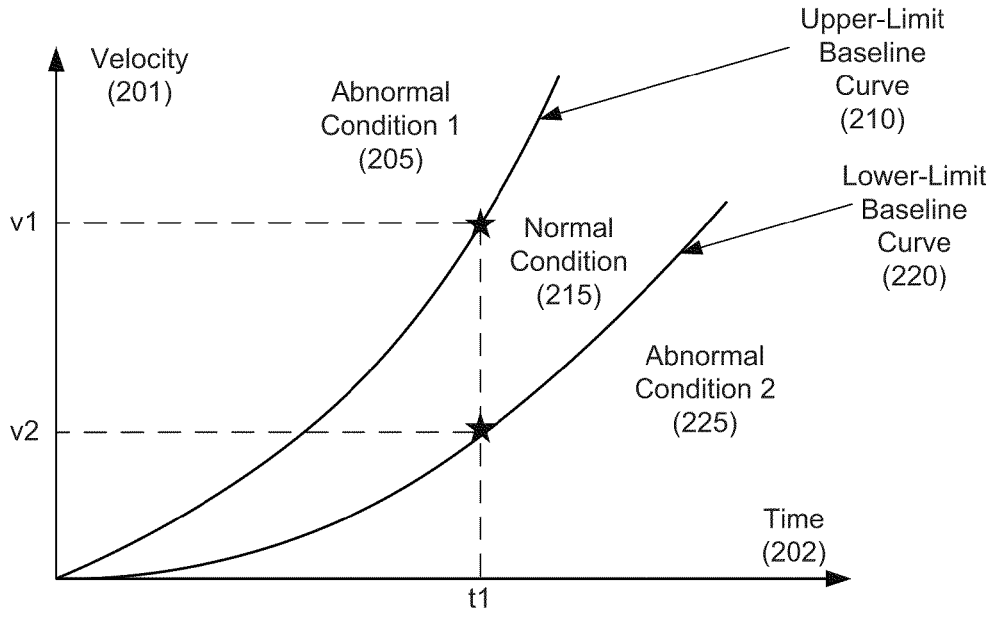
FIGS. 2A-2B show an example set of data analytic approaches used for determining operational status of an elevator.
Figure 2B:
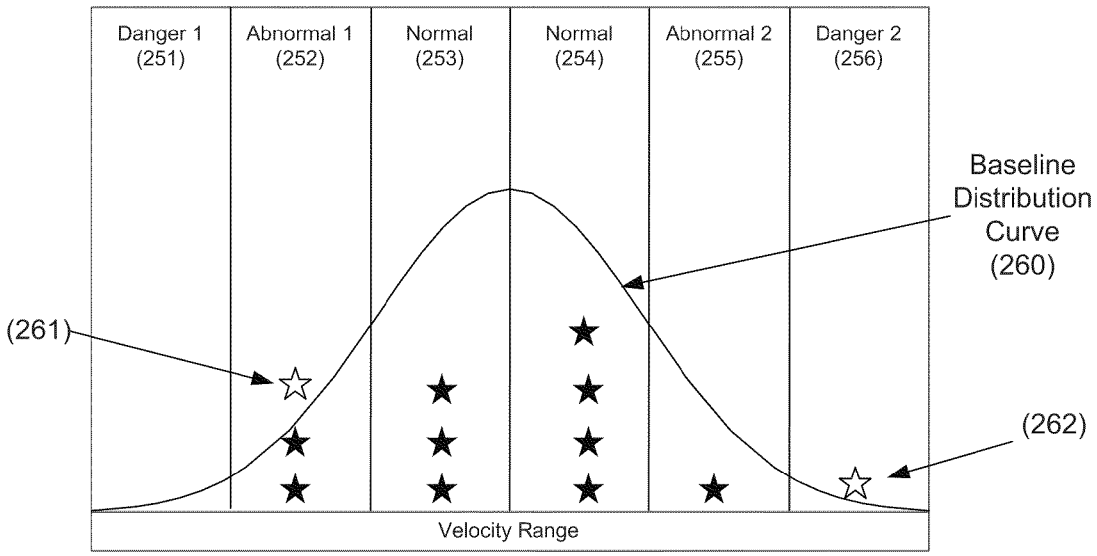

FIGS. 2A-2B show an example set of data analytic approaches used for determining operational status of an elevator, in accordance with at least some embodiments of the present disclosure. In some embodiments, a two-coordinate diagram may be used to analyze the acceleration rate of a moving elevator. The FIG. 2A diagram may display a motion graph under a velocity 201 and a time 202 coordination system. Thus, the FIG. 2A motion graph may be used to show the relationships between the velocities of a particular elevator in motion and the times the elevator spent during acceleration. Further, FIG. 2A is shown having two baseline curve lines 210 and 220, each of which represents a velocity change limit for a particular elevator. The upper-limit baseline curve 210 outlines the maximum baseline speeds in a period of time a normal elevator may be traveling safely. Likewise, the lower-limit baseline curve 220 illustrates the minimum baseline speeds a normal-functioning elevator should be operating under. For example, according to FIG. 2A, when an elevator has spent "t1" amount of time to accelerate, the elevator should be traveling within a maximum speed of v1 and a minimum speed of v2 in order for the operation of the elevator to be considered safe and normal.

In some embodiments, the velocity changes of a traveling elevator during acceleration may be collected by an acceleration sensor of a safety alarm system, and be transmitted to a processor or a remote monitoring system for data analysis. During analysis, these velocity changes may be mapped into a motion graph similar to the one in FIG. 2A. Afterward, the two baseline curves 210 and 220 may be applied to the motion graph, dividing the two-dimensional space of FIG. 2A into three areas: areas 205, 215 and 225. If at time "t1", the speed of the elevator is detected to be faster than v1, then the elevator's velocity curve would be falling into area 205, which is deemed operating under an "abnormal condition 1" 205. Likewise, if the speed of the elevator is below v2 at time t1, then the elevator operation is considered in an "abnormal condition 2" 225. Therefore, for any specific time spent accelerating, by comparing the collected operational measurements of an elevator with baseline measurements, a processor may quickly determine the operational status under which the elevator is operating with respect to acceleration.

In some embodiments, the two baseline curves 210 and 220 are retrieved from a memory of a safety alarm system based on a particular operational mode the elevator is in. Depending on the operational mode, the acceleration rate of an elevator may be different. For example, an elevator operating under a "loaded moving-up accelerating" operational mode has a different acceleration rate comparing to the same elevator operating under a "idle, moving-down accelerating" mode. Thus, the upper-limit and the lower-limit baseline measurements should take the operational mode into consideration in order to have a more meaningful determination of the operational status. Further, the operational mode may also be used to determine whether the baseline measurement should be loaded at all. For example, upon a determination that the elevator is in an "idle" operational mode, then any up or down motion detected by an acceleration sensor could indicate that the elevator is operating abnormally. Therefore, no baseline velocity measurement is needed in determining the operational status of the idle elevator.

In some embodiments, the above baseline comparison analysis may also be referred to as "reference analysis", since the real-time operational measurements are evaluated and analyzed with the reference baseline measurements. Further, reference analysis may also be applied to other operational measurements such as acceleration/deceleration rate, inclination rate, location, jittering, noise, light, smoke, etc. During operation, the processor may repeatedly perform operational mode identification and operational status determination based on the operational measurements continuously collected by the sensors. As soon as an elevator's new operational mode is identified, a different set of baseline measurements may be quickly retrieved and compared with the real-time operational measurements, resulting in real-time determinations of an elevator's operational status. Thus, the above approaches allow a safety alarm system to quickly detect any actual or potential problems an elevator is encountering or may be encountered.

FIG. 2B shows an illustrative embodiment of a distribution analysis of the operational measurements. In some embodiments, multiple velocity measurements collected through a period of time may be collectively analyzed according to statistical principles. For example, a distribution analysis evaluates the distribution of the measurements across a range of possible values. In FIG. 2B, the possible velocity values of a cruising elevator may be divided into six regions 251-256. If the sample velocity values are distributed according to standard deviation, then most of the velocity values should be in categorized into regions 253 and 254. Thus, when an elevator is traveling in a speed that should occur less frequently, the distribution analysis could detect anomaly when a certain amount of measurements indicated otherwise.

In some embodiments, a velocity measurement collected by an acceleration sensor is received by the processor. The measurement may then be categorized into one of the corresponding regions 251-256 according to the velocity value of the measurement. After a pre-determined number of measurements are collected and categorized, a baseline distribution curve 260 may be retrieved and compared with the distribution of these real-time measurements. The baseline distribution curve 260 illustrates that when a particular elevator operating normally, once the pre-determined number of measurements are categorized into the regions 251-256, the number of measurement in each of the regions 251-256 should be no more than the number of values indicated by the distribution curve 260 in the same region.

In some embodiments as illustrated in FIG. 2B, a distribution analysis may be performed for every 12 real-time measurements collected by a sensor. The 12 measurements may then be categorized into their corresponding regions in the distribution diagram. Afterward, the distribution is compared with the baseline distribution curve 260 to analyze whether these 12 measurements are distributed according to the baseline distribution. For example, in FIG. 2B, the baseline distribution curve 260 indicates that 2 out of 12 measurements having measurement values that fall into region 252 would be deemed normal. Thus, when 3 of the 12 measurements values 261 are categorized into the "abnormal 1" region 252, the number of measurement values in the abnormal region 252 becomes higher than the number indicated by the baseline distribution 260. Thus, the processor may determine that the elevator is functioning abnormally.

In some embodiments, if there were less than 3 measurements fall into region 252, then the 12 measurements would have been deemed having a normal distribution, and the elevator would have had a "normal" operational status. Likewise, the baseline distribution curve 260 may indicate that under no circumstance a velocity measurement should fall into either of the two "danger" regions 251 and 256. When a measurement 262 is shown to be classified into region 256, as illustrated in FIG. 2B, then the processor may deem the operational status of the elevator to be in "danger." Subsequently, warning signals may be generated to alarm the passengers and the maintenance crews. Thus, if the distribution of measurements fits the baseline distribution curve 260, the processor allows the occurrence of certain "abnormal" conditions, as long as the number of such "abnormal" conditions is limited.

In some embodiments, the measurements collected by various sensors may be stored as historical data to be analyzed later. For example, historical analysis may discover the gradual deterioration of certain performance parameters, and may be used to illustrate that even though the elevator is functioning normally, advance maintenance and repair may be necessary to further reduce the possibility of elevator accidents. Further, the collected operational measurements may be used as a form of baseline measurements for future evaluations. For example, the operational measurements collected when the elevator is new may be stored as baseline measurements, and may be later evaluated against the operational measurements collected from the same elevator which has been operating for a long period of time. Thus, by using the various data analysis approaches described above, the safety alarm system may be sufficient in providing advance warning to the safety of the elevator, without being limited by the type of elevators, the elevators' distinctive capacities, and the components installed therein.

Figure 3:
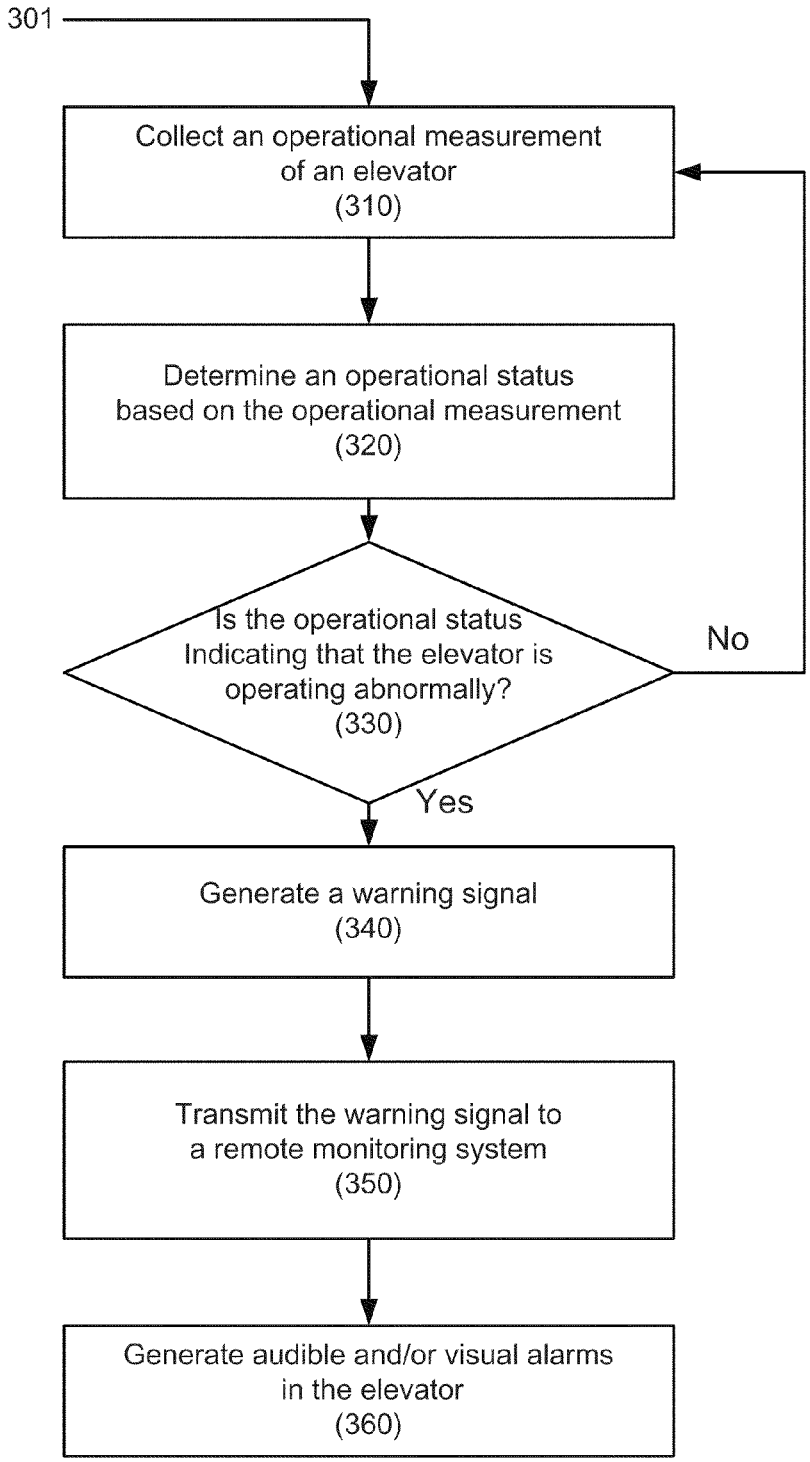
FIG. 3 is a flow diagram of an illustrative embodiment of a process for collecting operational measurements of an elevator and generating warning signals.

FIG. 3 is a flow diagram of an illustrative embodiment of a process 301 for collecting operational measurements of an elevator and generating warning signals. The process 301 sets forth various functional blocks or actions that may be described as processing steps, functional operations, events, and/or acts, which may be performed by hardware, software, and/or firmware. Those skilled in the art in light of the present disclosure will recognize that numerous alternatives to the functional blocks shown in FIG. 3 may be practiced in various implementations. In some embodiments, machine-executable instructions implementing the process 301 may be stored in the memory 155, executed by the processor 154, and/or implemented in the safety alarm system 150 of FIG. 1.

Process 301 may begin at block 310, "collect an operational measurement of an elevator." Block 310 may be followed by block 320, "determine an operational status based on the operational measurement." Block 320 may be followed by decision block 330, "is the operational status indicating that the elevator is operating abnormally?" If the elevator is operating abnormally, decision block 330 may be followed by block 340, "generate a warning signal." Otherwise, the decision block 330 may return to block 310. Block 340 may be following by block 350, "transmit the warning signal to a remote monitoring system." And the block 350 may be followed by block 360, "generate audible and/or visual alarms in the elevator."

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments. Moreover, one or more of the outlined steps and operations may be performed in parallel.

At block 310, a safety alarm system in an elevator may collect an operational measurement of the elevator. In an example implementation, the safety alarm system may use a sensor to collect the operational measurement of the elevator. The sensor may be, without limitation, an acceleration sensor, a noise sensor, or a smoke-detecting sensor designed to collect one of the many operational measurements such as, without limitation velocity, acceleration, vibration, shock, movement, or gravity acceleration. The sensor may generate a measurement output that may be further processed by the safety alarm system.

At block 320, the safety alarm system may determine an operational status of the elevator. In an example implementation, a processor in the safety alarm system may determine the operational status using or based on the operational measurements collected at block 310. The operational status may indicate whether the elevator is functioning normally, abnormally, or is broken. If the elevator is not operating in an ideal condition, the operational status may optionally contain additional information such as error code describing the type of problems and issues the elevator encounters. The additional information may be useful in diagnosing the cause of problems and repairing the elevator.

At decision block 330, the processor of the safety alarm system may make an evaluation to ascertain whether the operational status indicates that the elevator is operating abnormally or not. If the elevator is operating normally, then, at block 310, the same or a different sensor or sensors may continue to collect another operational measurement of the elevator. If the elevator is operating abnormally, then, at block 340, the safety alarm system may generate a warning signal based on the severity of the elevator problem. In an example implementation, the safety alarm system's processor may generate the warning signal. The warning signal may optionally include the operational measurement collected at block 310, the operational status determined at block 320, and other additional information to indicate the seriousness of the abnormal condition.

At block 350, the safety alarm system may transmit the warning signal to a remote monitoring system for further analysis. In an example implementation, the processor in the safety alarm system can utilize a communication adapter to transmit the warning signal. The remote monitoring system may monitor multiple elevators, and process warning signals transmitted from the safety alarm systems associated with the elevators. Further, the safety alarm system may optionally transmit a status signal to the remote monitoring system indicating that the safety alarm system is active in the monitoring of its respective elevator. Thus, by reviewing the warning signal, the proper repair procedures may be carried out in addition to the scheduled maintenance. Alternatively, the processor may also wirelessly transmit the warning signal to a client device. Such approach is advantageous since utilizing a client device may be more flexible than setting up a remote monitoring system.

At block 360, the safety alarm system may optionally generate alarm signals and send (i.e., provide or transmit) these signals to a warning system. The warning system may then generate audible and visual alarms to warn the passengers inside the elevator, so that passengers can be prepared with safety procedures before dangers occur, and the probability of physical injuries and property damages may be greatly reduced. The warning system may broadcast the audible alarms through the elevator's internal speaker and transmit the visual alarms to the elevator's lighting. Furthermore, the audible and visual alarms may also be used to control the elevator. For example, when coupled with the elevator's controlling components, the safety alarm system may add control signals to the alarm signals, so that the elevator may process the control signals to stop or disable an elevator before accident occurs. Therefore, by installing a portable safety alarm system in legacy elevators, the safety of the legacy elevators may be greatly improved, without incurring large expenses in upgrading these legacy elevators.

Figure 4:
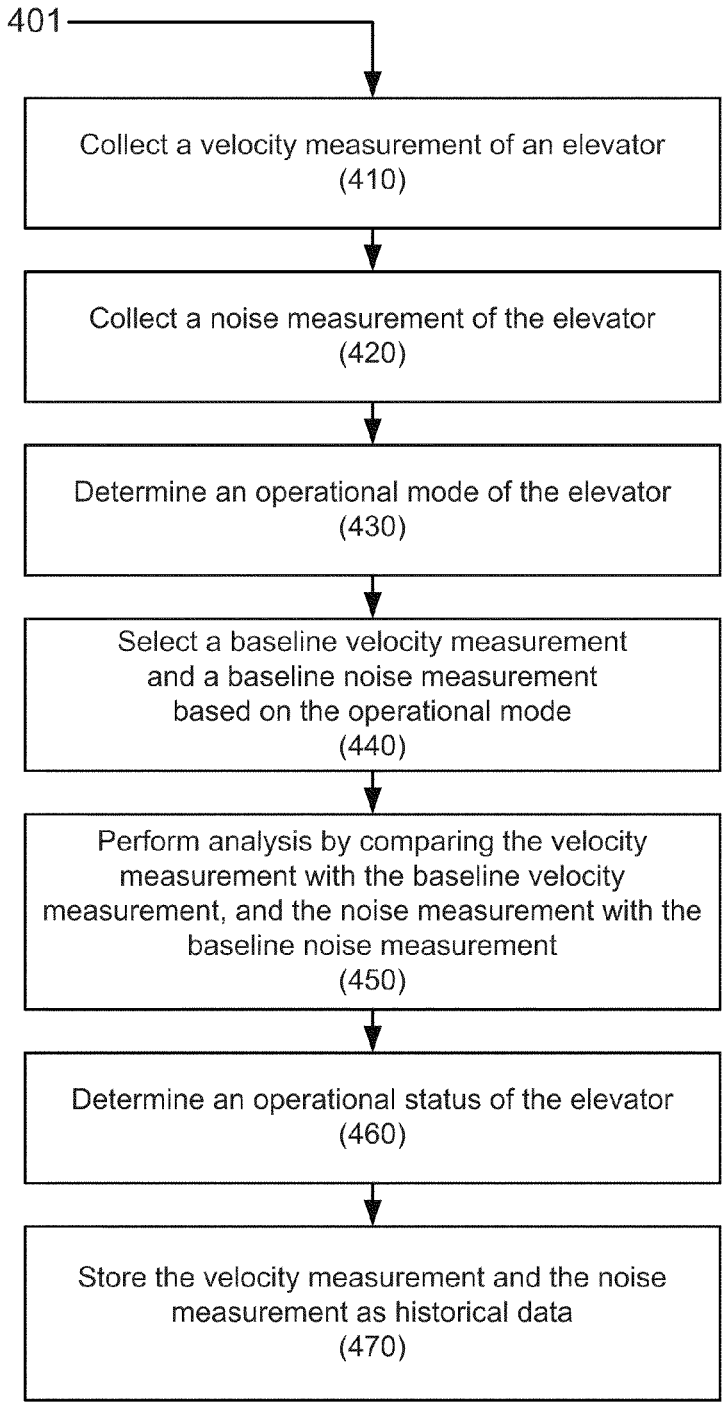
FIG. 4 is a flow diagram of an illustrative embodiment of a process for determining operational mode and operational status of an elevator.

FIG. 4 is a flow diagram of an illustrative embodiment of a process 401 for determining operational mode and operational status of an elevator, in accordance with at least some embodiments of the present disclosure. The process 401 sets forth various functional blocks or actions that may be described as processing steps, functional operations, events, and/or acts, which may be performed by hardware, software, and/or firmware. Those skilled in the art in light of the present disclosure will recognize that numerous alternatives to the functional blocks shown in FIG. 4 may be practiced in various implementations. In some embodiments, machine-executable instructions for the process 401 may be stored in the memory 155, executed by the processor 154, and/or implemented in the safety alarm system 150 of FIG. 1.

Process 401 may begin at block 410, "collect a velocity measurement of an elevator." Block 410 may be followed by block 420, "collect a noise measurement of the elevator." Block 420 may be followed by a block 430, "determine an operational mode of the elevator." Block 430 may be followed by block 440, "select a baseline velocity measurement and a baseline noise measurement based on the operational mode." Block 440 may be following by block 450, "perform analysis by comparing the velocity measurement with the baseline velocity measurement, and the noise measurement with the baseline noise measurement." Block 450 may be following by block 460, "determine an operational status of the elevator." And the block 460 may be followed by block 4700, "store the velocity measurement and the noise measurement as historical data."

At block 410, a safety alarm system in an elevator may collect a velocity measurement of an elevator in operation. In an example implementation, the safety alarm system may use an acceleration sensor to collect the velocity measurement of the elevator. In addition to the speed information, the velocity measurement may also contain acceleration/deceleration rate in one or multiple coordination axles. In some embodiments, the acceleration sensor may also collect a horizontal jittering of the elevator.

At block 420, the safety alarm system may collect a noise measurement of the elevator. In an example implementation, the safety alarm system may use a microphone to collect the noise measurement. The noise measurement may contain the various noise levels detected inside and outside of the elevator. Thus, when the elevator is in operation, the noise measurement may be referred to as the operational noise of the elevator. Similarly, when the elevator is idle, such a noise measurement may be referred to as an idle noise. Afterward, the velocity measurement and the noise measurement are then transmitted to the safety alarm system for further processing.

At block 430, the safety alarm system may determine the operational mode under which the elevator is operating. In an example implementation, a processor in the safety alarm system may determine the operational mode based on the velocity measurement and/or the noise measurement. In some embodiments, when the velocity measurement may indicate the elevator is not moving, and the operational mode may be determined to be "idle." Likewise, if the velocity measurement indicates that the elevator moves in certain direction, then the processor may ascertain that the elevator is moving up or down, and set the operational mode accordingly. Further, if the acceleration sensor detects acceleration or deceleration at block 410, then the operational mode may include such acceleration or deceleration indications as well.

In some embodiments, the velocity measurement may also be compared with certain baseline information to detect the operational mode of the elevator, such as whether the elevator is loaded or unloaded. Since an empty elevator may have a faster acceleration/deceleration rate than a loaded one, by comparing the real-time velocity measurement with a default measurement of an empty elevator, the processor may determine whether the elevator is loaded or not. Further, the processor may perform additional calculation to estimate the amount of weight the elevator is carrying. Similarly, the noise measurement may also be used to determine the operational mode of the elevator, as long as there are sufficient and distinguishable baseline noise measurements that are pre-generated under loaded and unloaded conditions.

At block 440, the safety alarm system may select a baseline velocity measurement and a baseline noise measurement based on the operational mode determined at block 430. In an example implementation, a processor of the safety alarm system may select the baseline velocity measurement and the baseline noise measurement from the memory of the safety alarm system. The baseline measurements may be previously collected by various sensors based on a new and functioning elevator operating under the same operational mode. For example, by collecting velocity measurements of a new or functioning elevator under an idle condition, a moving-up condition, a moving-down condition, an acceleration condition, a deceleration condition, a loaded condition, an unloaded condition, and/or the combination of the above conditions, the processor may store these collected measurements as baseline measurements associated with their corresponding operational modes. During operation, these baseline measurements may be quickly retrieved based on the specific elevator's operational mode. In some embodiments, each of the safety alarm system's sensors has a set of corresponding baseline measurements generated under various operational modes.

At block 450, the safety alarm system may perform various analysis by comparing the velocity measurement collected at block 410 with the baseline velocity measurement retrieved at block 440, and the noise measurement collected at block 420 with the baseline noise measurement retrieved at block 440. In an example implementation, the processor of the safety alarm system may perform reference analysis, distribution analysis, and/or optionally historical analysis based on the baseline data. At block 460, the safety alarm system may determine an operational status of the elevator based on the analysis result generated at block 450. In an example implementation, the processor of the safety alarm system may determine the operational status of the elevator. For example, the processor may determine that a single abnormal measurement collected from one sensor is sufficient in setting the operational status to "abnormal." Alternatively, the processor may evaluate all the measurements collected by different sensors and microphones, and assign an "abnormal" operational status if multiple measurements show anomaly. The determined operational status may then be utilized for generating of warning signals or alarms, as described in blocks 330, 340, 350 and 360 of FIG. 3.

At block 470, the safety alarm system may optionally save the velocity measurement collected at block 410, the noise measurement collected at block 420, the operational mode determined at block 430, and/or the operational status determined at block 460 as historical data to the memory of the safety alarm system. In an example implementation, the processor of the safety alarm system may save the above historical data. In some embodiments, the processor may transmit the stored historical data via a communication adapter to a remote monitoring system for further review. Thus, by periodically monitoring and review the historical data, additional data analysis, such as performance evaluation across different elevators or through different time periods, may be conducted to improve the efficiency of elevator maintenance tasks.

There is little distinction left between hardware and software implementations of aspects of systems; the use of hardware or software is generally (but not always, in that in certain contexts the choice between hardware and software can become significant) a design choice representing cost vs. efficiency tradeoffs. There are various vehicles by which processes and/or systems and/or other technologies described herein can be effected (e.g., hardware, software, and/or firmware), and that the preferred vehicle will vary with the context in which the processes and/or systems and/or other technologies are deployed. For example, if an implementer determines that speed and accuracy are paramount, the implementer may opt for a mainly hardware and/or a firmware configuration; if flexibility is paramount, the implementer may opt for a mainly software implementation; or, yet again alternatively, the implementer may opt for some combination of hardware, software, and/or firmware.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In some embodiments, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers (e.g., as one or more programs running on one or more computer systems), as one or more programs running on one or more processors (e.g., as one or more programs running on one or more microprocessors), as firmware, or as virtually any combination thereof, and that designing the circuitry and/or writing the code for the software and or firmware would be well within the skill of one of the skilled in the art in light of this disclosure. In addition, those skilled in the art will appreciate that the mechanisms of the subject matter described herein are capable of being distributed as a program product in a variety of forms, and that an illustrative embodiment of the subject matter described herein applies regardless of the particular type of signal bearing medium used to actually carry out the distribution. Examples of a signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

Those skilled in the art will recognize that it is common within the art to describe devices and/or processes in the fashion set forth herein, and thereafter use engineering practices to integrate such described devices and/or processes into data processing systems. That is, at least a portion of the devices and/or processes described herein can be integrated into a data processing system via a reasonable amount of experimentation. Those having skill in the art will recognize that a typical data processing system generally includes one or more of a system unit housing, a video display device, a memory such as volatile and non-volatile memory, processors such as microprocessors and digital signal processors, computational entities such as operating systems, drivers, graphical user interfaces, and applications programs, one or more interaction devices, such as a touch pad or screen, and/or control systems including feedback loops and control motors (e.g., feedback for sensing position and/or velocity; control motors for moving and/or adjusting components and/or quantities). A typical data processing system may be implemented utilizing any suitable commercially available components, such as those typically found in data computing/communication and/or network computing/communication systems.

The herein described subject matter sometimes illustrates different components contained within, or connected with, different other components. It is to be understood that such depicted architectures are merely exemplary, and that in fact, many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for the sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

We claim:

1. A method for determining the safety of an elevator, comprising:

collecting, by an acceleration sensor, an operational measurement of the elevator, wherein the operational measurement comprises a velocity measurement of the elevator;

determining, by a processor, an operational mode of the elevator by evaluating the operational measurement, wherein the operational mode indicates whether the elevator is loaded or unloaded;

determining, by the processor, an operational status of the elevator by evaluating the operational measurement and the operational mode, wherein the operational status indicates whether the elevator is operating normally or abnormally; and generating, by the processor, a warning signal when the operational status indicates that the elevator is operating abnormally.

2. The method of claim 1, wherein the operational measurement further comprises a noise measurement of the elevator collected by a noise sensor.

3. The method of claim 1, wherein the operational measurement further comprises a smoke-detection measurement of the elevator collected by a smoke-detecting sensor.

4. The method of claim 1, wherein the determining of the operational status further comprises:

determining, by the processor, the operational status of the elevator under the operational mode by comparing the operational measurement with a baseline operational measurement associated with the operational mode.

5. The method of claim 4, wherein the baseline operational measurement is determined based on historical operational measurements of the elevator.

6. The method of claim 1, wherein the determining of the operational status further comprises:

performing, by the processor, a reference analysis of the operational measurement against a baseline reference measurement; and upon a determination that the operational measurement deviates from the baseline reference measurement, assigning, by the processor, the operational status to be abnormal.

7. The method of claim 1, wherein the determining of the operational status further comprises:

performing, by the processor, a distribution analysis of the operational measurement against a baseline distribution measurement; and upon a determination that a distribution of the operational measurement deviates from the baseline distribution measurement, assigning, by the processor, the operational status to be abnormal.

8. The method of claim 1, further comprising transmitting, by the processor, the warning signal to a remote monitoring system.

9. The method of claim 1, further comprising generating, by a warning system, audible and visual alarms in the elevator.

10. The method of claim 1, further comprising:

storing, by the processor, the operational measurement as a part of a historical data; and determining, by the processor, the operational status of the elevator by performing historical analysis on the historical data.

11. A method for determining the safety of an elevator, comprising:

collecting, by an acceleration sensor, a velocity measurement of the elevator as the elevator is in operation;

collecting, by a noise sensor, a noise measurement of the elevator as the elevator is in operation;

determining, by the processor, an operational mode of the elevator based on the velocity measurement, wherein the operational mode indicates whether the elevator is loaded or unloaded; and determining, by a processor, an operational status of the elevator by comparing the velocity measurement with a baseline velocity measurement associated with the operational mode and comparing the noise measurement with a baseline noise measurement associated with the operational mode, wherein the operational status indicates whether the elevator is operating normally or abnormally.

12. The method of claim 11, further comprising:

selecting, by the processor from historical data, the baseline speed measurement and the baseline noise measurement that are associated with the operational mode.

13. The method of claim 11, wherein the collecting of the velocity measurement further comprises:

collecting, by the acceleration sensor, acceleration rate of the elevator; and collecting, by the acceleration sensor, horizontal jittering of the elevator.

14. The method of claim 11, wherein the collecting of the noise measurement further comprises:

collecting, by the noise sensor, operational noise of the elevator; and collecting, by the noise sensor, idle noise of the elevator.

15. A system configured to determine the safety of an elevator, comprising:

an acceleration sensor to collect a velocity measurement of the elevator;

a microphone to collect a noise measurement of the elevator; and a processor coupled with the acceleration sensor and the microphone, the processor configured to determine an operational mode of the elevator from the velocity measurement, wherein the operational mode indicates whether the elevator is loaded or unloaded, to determine an operational status of the elevator from the operational mode, the velocity measurement and the noise measurement, wherein the operational status indicates whether the elevator is operating normally or abnormally, and to generate a warning signal upon a determination that the operational status indicates that the elevator is operating abnormally.

16. The system of claim 15, further comprising:

a communication adapter coupled with the processor, the communication adapter configured to transmit the warning signal to a remote monitoring system.

17. The system of claim 15, wherein the communication adapter is configured to support wireless communication.

18. The system of claim 15, further comprising a memory coupled with the processor, the memory configured to store the velocity measurement, the noise measurement, and the operational status as a historical data.

19. The system of claim 18, wherein the memory is configured to store a baseline velocity measurement for comparing with the velocity measurement and a baseline noise measurement for comparing with the noise measurement.

20. The system of claim 15, further comprising a warning component coupled with the processor, the warning component configured to generate audible and visual alarms in the elevator based on the warning signal.

* * * * *

UNITED STATES PATENT AND TRADEMARK OFFICE

CERTIFICATE OF CORRECTION

PATENT NO. : 8,893,858 B2
APPLICATION NO. : 13/141327
DATED : November 25, 2014
INVENTOR(S) : Shi et al.

It is certified that error appears in the above-identified patent and that said Letters Patent is hereby corrected as shown below:

Delete title page and substitute therefore with the attached title page consisting of the corrected illustrative figure.

Delete Drawing Sheet 1 of 4 and substitute therefore with the attached Drawing Sheet 1 of 4.

In the specification

In Column 1, Line 7, delete "371" and insert -- 35 U.S.C. § 371 --, therefor.

In Column 6, Line 23, delete "FIG. 1)" and insert -- FIG. 1). --, therefor.

In Column 9, Line 48, delete "abnormally?"" and insert -- abnormally?". --, therefor.

In Column 13, Line 48, delete "and or" and insert -- and/or --, therefor.

Signed and Sealed this
Twenty-ninth Day of December, 2015

Michelle K. Lee

Michelle K. Lee
*Director of the United States Patent and Trademark Office*

(12) United States Patent
Shi et al.

(10) Patent No.: US 8,893,858 B2
(45) Date of Patent: Nov. 25, 2014

(54) METHOD AND SYSTEM FOR DETERMINING SAFETY OF ELEVATOR

(75) Inventors: Juan Shi, Heilongjiang (CN); Pei Qing, Heilongjiang (CN); Yixuan Zou, Heilongjiang (CN)

(73) Assignee: Empire Technology Development LLC, Wilmington, DE (US)

( * ) Notice: Subject to any disclaimer, the term of this patent is extended or adjusted under 35 U.S.C. 154(b) by 662 days.

(21) Appl. No.: 13/141,327

(22) PCT Filed: Jun. 29, 2010

(86) PCT No.: PCT/CN2010/074675
§ 371 (c)(1),
(2), (4) Date: Jun. 22, 2011

(87) PCT Pub. No.: WO2012/000170
PCT Pub. Date: Jan. 5, 2012

(65) Prior Publication Data
US 2011/0315490 A1 Dec. 29, 2011

(51) Int. Cl.
*B66B 1/34* (2006.01)
*B66B 5/00* (2006.01)

(52) U.S. Cl.
CPC ..... *B66B 5/0025* (2013.01)
USPC ..... 187/391; 187/247

(58) Field of Classification Search
USPC ..... 187/247, 391, 393
See application file for complete search history.

(56) References Cited

U.S. PATENT DOCUMENTS

| | | | | |
|---|---|---|---|---|
| 4,512,442 | A * | 4/1985 | Moore et al | 187/393 |
| 5,064,026 | A * | 11/1991 | Nagata et al. | 187/391 |
| 5,522,480 | A * | 6/1996 | Hofmann | 187/391 |
| 5,869,794 | A | 2/1999 | Spiess | |
| 7,143,001 | B2 | 11/2006 | Karasek | |
| 7,823,706 | B2 * | 11/2010 | Tyni et al | 187/393 |
| 8,418,815 | B2 * | 4/2013 | Encinas Carreno et al | 187/390 |
| 8,540,057 | B2 * | 9/2013 | Schuster et al | 187/391 |

FOREIGN PATENT DOCUMENTS

| | | |
|---|---|---|
| CN | 1673062 | 9/2005 |
| CN | 101172550 | 5/2008 |
| CN | 101500924 | 8/2009 |
| JP | 9-2752 | 1/1997 |
| JP | 11217163 | 8/1999 |
| JP | 2006-8381 | 1/2006 |
| JP | 200784243 | 4/2007 |

OTHER PUBLICATIONS

Notification of Transmittal of the International Search Report and the Written Opinion of the International Searching Authority, Apr. 7, 2011.

* cited by examiner

*Primary Examiner* — Anthony Salata
(74) *Attorney, Agent, or Firm* — Ren-Sheng International

(57) ABSTRACT

In accordance with at least some embodiments, a process for determining the safety of an elevator may be implemented to collect, by an acceleration sensor, an operational measurement of the elevator in operation, wherein the operational measurement includes a velocity measurement of the elevator. The process may be implemented to determine, by a processor, an operational status of the elevator by evaluating the operational measurement. The process may further be implemented to generate, by the processor, a warning signal when the operational status indicates that the elevator is operating abnormally.

20 Claims, 4 Drawing Sheets

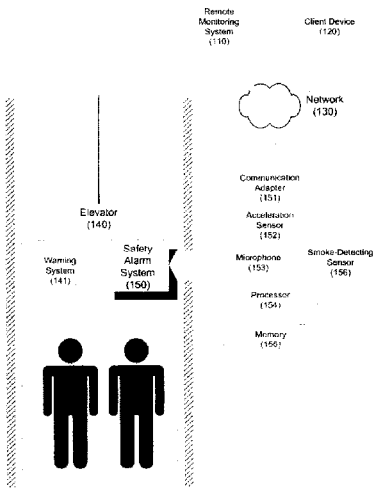

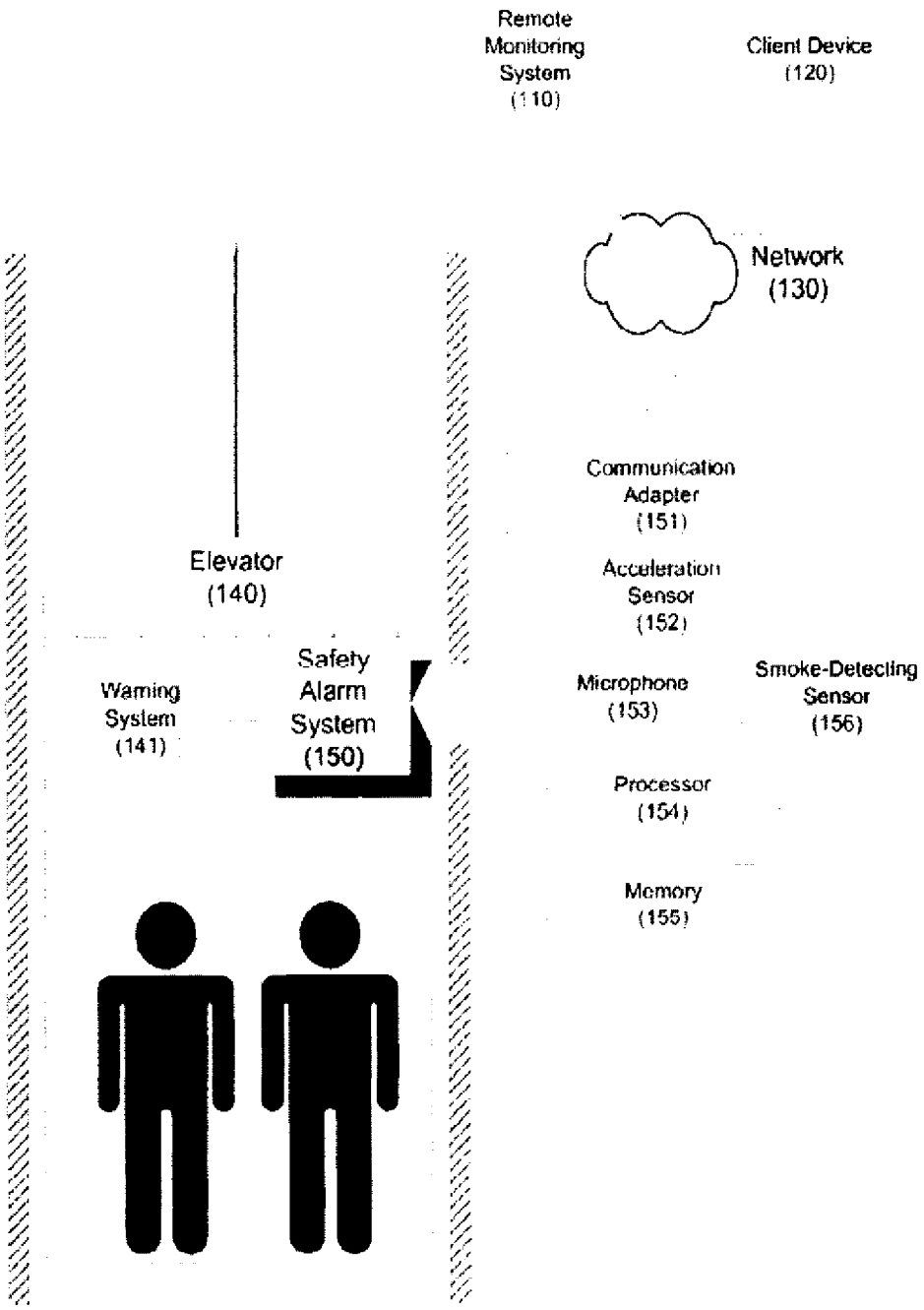
Remote Monitoring System (110)
Client Device (120)
Network (130)
Elevator (140)
Communication Adapter (151)
Acceleration Sensor (152)
Safety Alarm System (150)
Warning System (141)
Microphone (153)
Smoke-Detecting Sensor (156)
Processor (154)
Memory (155)